US007896980B2

(12) United States Patent
Chou

(10) Patent No.: US 7,896,980 B2
(45) Date of Patent: Mar. 1, 2011

(54) NITRIDING-OXIDIZING TREATMENT METHOD FOR METAL

(76) Inventor: Ting-Cheng Chou, Taoyuan (TW)

( * ) Notice: Subject to any disclaimer, the term of this patent is extended or adjusted under 35 U.S.C. 154(b) by 871 days.

(21) Appl. No.: 11/802,022

(22) Filed: May 18, 2007

(65) Prior Publication Data

US 2007/0267105 A1 Nov. 22, 2007

(51) Int. Cl.
*C23C 8/28* (2006.01)

(52) U.S. Cl. ..... 148/209

(58) Field of Classification Search ..... 148/209, 148/217; 427/455.29, 213
See application file for complete search history.

(56) References Cited

U.S. PATENT DOCUMENTS 4,786,526 A * 11/1988 Arai et al. ..... 427/249.17

* cited by examiner

*Primary Examiner* — Roy King
*Assistant Examiner* — Jessee R. Roe
(74) *Attorney, Agent, or Firm* — Birch, Stewart, Kolasch & Birch, LLP

(57) ABSTRACT

The present nitriding-oxidizing method for a metal member is imposed, which includes providing a powdery nitriding agent comprised of a powdery nitride compound and inorganic powder, wherein the powdery nitride compound decomposes below a nitriding-oxidizing temperature to generate nitriding gas, and the inorganic powder does not react; embedding an essential part of the metal member to be nitrided and oxidized into the powdery nitriding agent, and then performing nitridization-oxidization while an oxygen-containing gas is always present in the powdery nitriding agent; and, if necessary, allowing the metal member after nitridization-oxidization to carry out a reoxidization in an oxygen-containing atmosphere. The method of the present invention has a broader temperature range for nitridization-oxidization.

4 Claims, 5 Drawing Sheets

NITRIDING-OXIDIZING TREATMENT METHOD FOR METAL

FIELD OF THE INVENTION

The present invention relates to nitriding-oxidizing methods and methods for nitriding-oxidizing and reoxidizing ferrous alloys and non-ferrous alloys; and in particular to a nitriding-oxidizing method and a method for nitriding-oxidizing and reoxidizing ferrous alloys and non-ferrous alloys, wherein a powdery nitriding agent comprises a powdery nitride compound and an inorganic powder is used, wherein the powdery nitride compound decomposes below a nitriding-oxidizing temperature to generate nitriding gas, and the inorganic powder does not react in the nitridization-oxidization.

BACKGROUND OF THE INVENTION

Salt bath (soft) nitriding, powder nitriding, gas (soft) nitriding, plasma nitriding, and the like are well-known nitriding processes for metals. For example, when ferrous alloys undergo nitridation, $Fe_{2-3}N$ and $Fe_{3-4}N$ are usually formed on the top surfaces of the alloys. Despite exhibiting an increment in strength, a diffusion layer is formed by to nitrogen diffusion, which causes hardening from the top surface to the diffusion layer, resulting in toughness degradation. When a hot work tool steel is nitrided, it inclines to have a decreasing thermal fatigue resistance. Moreover, oxygen is expelled prior to nitridization in conventional nitriding processes, causing oxides not to exist on the top surface of a metal and oxygen not to diffuse through the diffusion layer, thus non-ferrous alloy fluid has poor anti-seizing and melting loss resistance.

In the case of salt bath (soft) nitriding, the nitriding temperature used is high. The high nitriding temperature causes the treated objects to have a variation in dimension and softening in hardness. In the case of plasma nitriding, it is difficult to generate a uniformly nitrided layer on the surface of a treated object having a complicated shape (even though the diffusion layer is deeper).

Several powder nitriding methods have been developed. Their treatment conditions are dependent upon thermal decomposition of nitrogen-containing compounds. The nitriding time is limited to within 3 hr, and the treatment temperature is restricted to the range of 500 to 600° C. The more carbon the base metal has, the more difficult it is for nitrogen to diffuse into bottom layers of the base metal. Thus, it is difficult to perform nitridization on dies or components of cold work tool steels with high-carbon under the condition of nitriding within 3 hr and at 500° C. In order to nitride cold work tool steels within 3 hr, it is necessary to keep the nitriding temperature higher than 500° C. However, it is not easy to maintain a dimension accuracy under such a temperature, therefore the temperature condition cannot be practically used for dies or components requiring a micro unit accuracy in dimension. Furthermore, according to conventional powder nitriding methods, thermal decomposition and nitrogen generation of nitrogen-containing compounds occur at a lower temperature. Thus, it is hard to adjust and change the temperature range, the time of thermal decomposition, and the nitrogen generation of the nitrogen-containing compounds to form a nitrided layer at a high temperature. Once the nitriding temperature is over 600° C., nitridization cannot be improved.

According to conventional powder nitriding methods, objects to be treated begin nitriding at about 500° C. The nitriding time and temperature are restricted to within 3 hrs and between 500 to 600° C., respectively. Consequently, the rate of increased temperature of powdery nitridants during heating and decomposition should be compatible with the rate of increasing and the maintenance of the temperature of treated objects when big and batch objects are operated. However, efficient nitriding methods suitable for applications of various steels are not available.

Regarding methods for aluminum alloy casting, for example, gravity casting, low pressure casting, differential pressure casting, semisolid metal casting, squeeze casting, die casting, and the like can be mentioned. Some problems, such as seizing, melting loss, and crazing of the lateral surface of a die cavity during casting, can occur. Due to the shape designed on the lateral surface of a die cavity, the die has a different wall thickness, which causes a temperature difference in the lateral surface of the die cavity during casting process. Moreover, repeated heating and cooling creates thermal and tensile stresses on the surface of a die, causing metal fatigue. The phenomenon of crazing occurs on the die due to metal fatigue caused by repeated heating and cooling is called "thermal fatigue".

A molten aluminum alloy, such as ADC12 or A356.1, is cast by keeping in a die cavity at 620 to 750° C. for tens of seconds to several minutes. During this period, a so-called Fe—Al—Si layer between metals is formed (also referred to as "seizing") between the molten aluminum alloy and the die material, and this layer is then peeled off in successive casting processes. Such a phenomenon is called "melting loss".

As for a die material, materials of SKD-61 series in accordance with Japan Industrial Standards is generally used in the state of annealed material or applied after quenching and annealing. Although refining and thermal treatment techniques for die material have been improved, and various surface treatment methods have also been developed, there are still problems of crazing, seizing, and melting loss.

It is difficult to nitride ferrous alloys and non-ferrous alloys having inert coatings by conventional nitriding methods, therefore a pretreatment for eliminating inert coating is required.

Although methods combining nitridization and oxidization have been practiced or reported, these methods do not improve the melting loss of molten non-ferrous alloys. In a homo treatment process, steam is used to form oxidized coatings. However, the oxidized coatings cannot significantly prevent melting loss. In order to decrease melting loss, it is believed that thickening a conversion layer by nitridization is an effective method. However, in the cases of forming a CrN layer and an oxidized layer, if a deep nitriding diffusion layer cannot be formed, an oxidized layer is hardly formed, either. On the other hand, peeling or crazing occurs if a deeply nitrided diffusion layer is formed.

SUMMARY OF THE INVENTION

To overcome the above-mentioned problems of the prior art, an object of this invention to provide a nitriding-oxidizing method and a method for nitriding-oxidizing and reoxidizing a metal member. That is, to provide a nitriding-oxidizing method, in which a wider temperature range for nitridization-oxidization is used.

Another object of this invention is to provide a nitriding-oxidizing method and a method for nitriding-oxidizing and reoxidizing a metal member to enhance thermal fatigue resistance of hot work tool steels.

A further object of this invention is to provide a nitriding-oxidizing method and a method for nitriding-oxidizing and reoxidizing a metal member to maintain dimension precision of a treated object.

Still another object of this invention is to provide a nitriding-oxidizing method and a method for nitriding-oxidizing and reoxidizing a metal member to allow ferrous alloys or non-ferrous alloys with inert coatings to be nitrided.

Still another object of this invention is to provide a nitriding-oxidizing method and a method for nitriding-oxidizing and reoxidizing a metal member to inhibit seizing and melting loss of ferrous alloys and non-ferrous alloys.

Yet another object of this invention is to provide a nitriding-oxidizing method for and a method for nitriding-oxidizing and reoxidizing a metal member to eliminate thermal cracking, seizing, and melting loss of aluminum alloy casting dies.

To achieve the above-mentioned and other objects, a powdery nitriding agent comprised of a powdery nitride compound and an inorganic powder is provided, wherein the powdery nitride compound decomposes below the nitriding-oxidizing temperature to generate nitriding gas, but the inorganic powder does not react That is, the nitriding-oxidizing method for a metal member, of the present invention, comprises the steps of: providing a powdery nitriding agent comprised of 10 to 90% by volume of a powdery nitride compound and 90 to 10% by volume of an inorganic powder, wherein the powdery nitride compound has an average particle size of 1 to 10 μm and decomposes below the nitriding-oxidizing temperature to generate nitriding gas, and the inorganic powder has an average particle size of 20 to 100 μm but does not react in the nitridization-oxidization; and embedding an essential part to be nitrided and oxidized, of the metal member, into the powdery nitriding agent, wherein the metal member is composed of ferrous alloys or non-ferrous alloys; and performing nitridization-oxidization at a temperature of 400 to 900° C. for 0.5 to 20 hours, while an oxygen-containing gas is always present in the powdery nitriding agent.

Moreover, the method for nitriding-oxidizing and reoxidizing a metal member, of the present invention, comprises the steps of: providing a powdery nitriding agent comprised of 10 to 90% by volume of a powdery nitride compound and 90 to 10% by volume of an inorganic powder, wherein the powdery nitride compound has an average particle size of from 1 to 10 μm and decomposes below the nitriding-oxidizing temperature to generate a nitriding gas, and the inorganic powder has an average particle size of from 20 to 100 μm and does not react in nitridization-oxidization; embedding an essential part to be nitrided and oxidized, of the metal member, into the powdery nitriding agent, wherein the metal member is composed of ferrous alloys or non-ferrous alloys; and carrying out nitridization-oxidization at a temperature of 400 to 900° C. for 0.5 to 20 hours, while an oxygen-containing gas is always present in the powdery nitriding agent; and carrying out oxidization of the metal member after nitridization-oxidization in an oxygen-containing atmosphere at a temperature of 400 to 900° C. for 0.25 to 8 hours.

By using the nitriding-oxidizing method or the method for nitriding-oxidizing and reoxidizing a metal member, of the present invention, efficacies described in the following can be achieve:

1. A temperature range for nitridization-oxidization can be broadened from 500 to 600° C. to 400 to 900° C.
2. Thermal fatigue resistance of hot work tool steels can be enhanced. That is, the properties of the oxidized layer, nitrided layer, and diffusion layer can be modified according to the present invention. It is well known that removing $Fe_{2-3}N$ and $Fe_{3-4}N$ layers to form a small hardness gradient is an effective measure for improving thermal fatigue resistance of tool steels.
3. Dimension precision of treated objects can be maintained by using the nitriding-oxidizing method of the present invention at low temperatures. The method is applicable to cold work tool steels, dies, and parts of alloy steels requiring a specific wear resistance. That is, the nitriding-oxidizing method and the method for nitriding-oxidizing and reoxidizing a metal member, of the present invention, can also be performed at a temperature lower than 500° C., so that precision of dimension of tool steels and alloy steals can be kept in the micro unit.
4. In the nitriding-oxidizing method for a metal member, of the present invention, nitridization-oxidization can be applied to ferrous alloys and non-ferrous alloys having inert coatings without pretreatment for removing the oxidized coatings by degrading powdery nitride compounds into hydrogen ions at high temperatures and reducing such hydrogen ions with oxygen in the inert oxidized coatings.
5. Seizing and melting loss of ferrous alloys and non-ferrous alloys can be inhibited by the method for nitriding-oxidizing and reoxidizing a metal member, of the present invention. Although there are strong metal reactions between aluminum alloys and ferrous steels, for example, in the processes of gravity casting, low pressure casting, differential pressure casting of aluminum alloy, the problem of melting loss can be solved. Similarly, melting loss of lead free tin alloys for soldering, and melting loss of solder bath due to reactions between metals can be overcome. Furthermore, the method of the present invention is carried out in the oxygen-containing atmosphere, thus $Cr_2O_3$ precipitate is present in the diffusion layer and a mixture layer of $Cr_2O_3$ and $Cr_2N$ is formed in the oxidized layer. Consequently, electrochemical reactions between metals can be terminated, and melting loss can be inhibited.
6. Thermal cracking, seizing, and melting loss of dies for aluminum alloy casting can be overcome by improving the toughness of the diffusion layer and forming compression stress. These problems can also be solved by controlling the thickness of the mixture layer of $Cr_2O_3$ and $Cr_2N$ to terminate the reaction with molten aluminum alloy, and to retard the initial disruption caused by grain boundary.

DETAILED DESCRIPTION OF THE PREFERRED EMBODIMENTS

Figure 1:
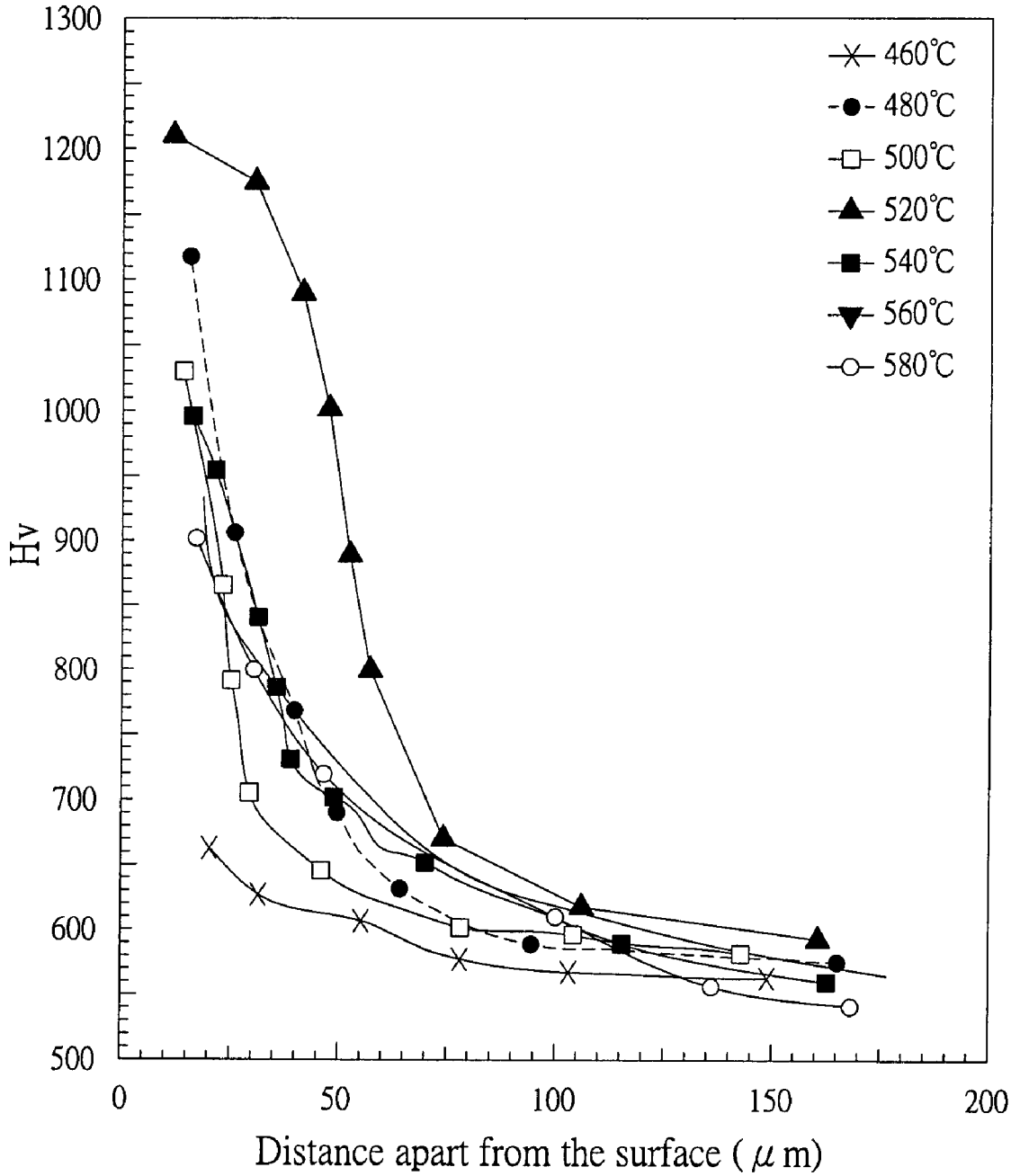
FIG. 1 is a graph of the measured hardness distribution according to the first embodiment of the present invention.

The nitriding-oxidizing method for a metal member, of the present invention, comprises the steps of: providing a powdery nitriding agent comprised of 10 to 90% by volume of a powdery nitride compound and 90 to 10% by volume of an inorganic powder, wherein the powdery nitride compound has an average particle size of 1 to 10 μm and can decompose below a nitriding-oxidizing temperature to generate nitriding gas, and the inorganic powder has an average particle size of 20 to 100 μm and does not react; and embedding an essential part of the metal member to be nitrided and oxidized into the powdery nitriding agent, wherein the metal member is composed of ferrous alloys or non-ferrous alloys; and proceeding nitridization-oxidization at a temperature of 400 to 900° C. for 0.5 to 20 hours, while an oxygen-containing gas is always present in the powdery nitriding agent.

The powdery nitriding agent composed of 10 to 90% by volume of a powdery nitride compound and 90 to 10% by volume of an inorganic powder is preferred. Moreover, a powdery nitride compound with an average particle size of 1 to 10 μm and an inorganic powder with an average particle size of 20 to 100 μm are preferred. In the present invention, the average particle size is determined by scanning electronic microscopy (SEM). If the amount of the powdery nitride compound in the powdery nitriding agent is less than 10% by volume (i.e., the amount of the inorganic powder is more than 90% by volume), nitridization may be incomplete. To the contrary, if the amount of the powdery nitride compound in the powdery nitriding agent is more than 90% by volume (i.e., the amount of the inorganic powder is less than 10% by volume), the oxygen-containing gas existing in the powdery nitriding agent is insufficient. Thus, oxides cannot be formed sufficiently. In these cases, the effect of the nitridization-oxidization will be reduced.

When a metal member undergoes nitridization-oxidization or the nitridization-oxidization and reoxidization according to the present invention, it is preferred that the metal member consisting of ferrous alloys or non-ferrous alloys (for example, nickel alloy, cobalt alloy, and titanium alloy) contain chromium, molybdenum, manganese, tungsten, vanadium or aluminum as nitrided elements. As the metal member consisting of ferrous alloys or non-ferrous alloys undergoes nitridization-oxidization, the essential part of the metal member to be nitrided and oxidized is embedded in the powdery nitriding agent, and is then heated at a temperature of 400 to 900° C., while an oxygen-containing gas (air or oxygen-rich air) is always present in the powdery nitriding agent. Preferably, the heating time (the nitriding-oxidizing time) is about 0.5 to 20 hours. If, for example, an electrical furnace is used in nitridization-oxidization, the electric furnace can be an open type, a hermetic type, or an oxygen controllable type electric furnace.

In nitridization-oxidization, oxygen-containing gas always exists in a powdery nitriding agent (if necessary, the oxygen-containing gas can be supplied into the powdery nitriding agent, simultaneously), so that oxygen can diffuse from the surface of the treated metal member into the inner part thereof to react with Cr contained inside to form $Cr_2O_3$ precipitate. This inner oxidation retards nitrogen diffusion and allows hardness gradient to decrease, so that the toughness of the substrate can be maintained. However, oxide ($Cr_2O_3$) precipitate is not formed in the diffusion layer according to conventional nitriding processes.

Applying a temperature program described below can eliminate moisture generated in the early steps of nitridization-oxidization. Furthermore, by controlling the temperature and elapsing time for generating nitrogen, as well as heating the treated objects, nitridization-oxidization can be applied to big and batch objects.

<Nitriding Agent and Treated Objects are Heated Simultaneously>

1. The time required for increasing temperature is dependent on the heating capacity of the furnace and the dimension of the objects to be treated, and is constantly modified during each furnace operation.
2. Heating profile is directly increased from room temperature to a predetermined temperature, and then it is held.
3. After the heating profile is increasing from room temperature to 200±20° C., it is held for a specific period of time, and then it is increased to the predetermined temperature and held. The purpose of this temperature program is to allow moisture to be evaporated, powdery nitriding agent to be preheated, and the temperature of the treated objects to be controlled.
4. After the heating profile is increased from room temperature to 360±20° C., it is held for a specific period of time, and then it is increased to the predetermined temperature and held.
5. The heating profile is raised from room temperature to 200±20° C., it is held for a specific period of time, then it is raised to 360±20° C. and is held for a specific period of time, and is further increased to the predetermined temperature and held.

<Nitriding Agent and Treated Objects are Heated Separately>

The powdery nitriding agent is preheated to 180±20° C. and held. The objects to be treated are heated to the predetermined temperature. Thereafter, these objects are placed in the preheated powdery nitriding agent, or the preheated powdery nitriding agent is placed around these objects. The purpose of this temperature program is to allow generated nitriding gas to be used sufficiently by heating the objects to the nitriding temperature, so that big objects can be treated by this method. Moreover, the bigger the objects to be treated, the bigger the difference among temperature increasing rate of the objects to be treated, hot air in the furnace, and the powdery nitriding agent. Such a difference can be eliminated when nitriding agent and treated objects are heated separately.

The thickness and composition of the surface compound layers and the diffusion layer produced in the nitriding-oxidizing method of the present invention, for example, is shown as followed:

Oxides layer: 1 to 3 μm in thickness, including $Fe_2O_3$, $Fe_3O_4$, $FeCr_2O_4$ and $Cr_2O_3$.

Nitrides layer: 1 to 2 μm in thickness, including $Cr_2N$ and CrN.

Diffusion layer: 10 to 150 μm in thickness, including a nitrogen diffusion layer and $Cr_2O_3$ precipitate.

When nitridization-oxidization is carried out on tool steels, alloy steels, or metal members having inert coating by using powdery nitriding agent, suitable treatment conditions are exemplified as below:

1. In the case that high surface hardness and high wear resistance are required, the amount of the powdery nitride compound to be used in the powdery nitriding agent is less than 40% by volume, and the nitriding-oxidizing treatment temperature is set at 500 to 540° C., preferably. This process is suitable for, for example, SKD61 of high-carbon cold work tool steels, dies and parts of high-speed tool steels, and the casting dies and parts of SKD61 of hot work tool steels tending to be highly worn. That is, to improve nitrogen diffusion in high-carbon steels, it is preferred to decrease the amount of the powdery nitride compound in the powdery nitriding agent to increase the amount of oxygen.
2. In the case that high thermal fatigue resistance and the diffusion layer with small hardness gradient are required, the amount of the powdery nitride compound to be used in the powdery nitriding agent is 20 to 60% by volume, and the nitriding-oxidizing temperature is set at 520 to 560° C., preferably. This process is suitable for, for example, casting dies and hot forging dies of SKD61 of hot work tool steels having severe thermal fatigue.

3. In the case that the wear due to impact and softening of hardness due to operation at high temperatures, the amount of the powdery nitride compound to be used in the powdery nitriding agent is more than 60% by volume, and the nitriding-oxidizing temperature is set at 540 to 580° C., preferably. This process is suitable for, for example, hot forging dies.
4. In the case that high surface strength and wear resistance are required for cold work tool steels and a small hardness gradient of the diffusion layer is needed, preferably, the amount of the powdery nitride compound to be used in the powdery nitriding agent is 20 to 60% by volume, and the nitriding-oxidizing temperature is set at 480 to 520° C. This process is suitable for, for example, cold forging dies and punch dies.

When nitridization-oxidization is carried out on high-chromium steels by using powdery nitriding agent, suitable treatment conditions are exemplified as below:

1. It is preferred that the amount of the powdery nitride compound to be used in the powdery nitriding agent is 40 to 80% by volume.
2. Because high chromium steels are mostly applied to dies and parts having the requirement of dimension precision, the nitriding-oxidizing temperature is preferably set at 500 to 540° C. Nevertheless, in the case that the dimension precision is in the micrometer unit, the nitriding-oxidizing temperature is preferably set at 480 to 500° C., so that the holding time of nitridization-oxidization can be increased.
3. In the case that dies and parts have close tolerance, the nitriding-oxidizing temperature is preferably set at 540 to 560° C.
4. It is preferred to perform reoxidization after nitridization-oxidization is carried out.

As for metal members having inert coatings, for example, metal member consisting of titanium alloys, the preferred nitriding-oxidizing temperatures are higher than 700° C. (due to hard inert coating).

The method for nitriding-oxidizing and reoxidizing for a metal member, of the present invention, comprises the steps of: providing a powdery nitriding agent comprised of 10 to 90% by volume of a powdery nitride compound and 90 to 10% by volume of an inorganic powder, wherein the powdery nitride compound has an average particle size of from 1 to 10 μm and decomposes below a nitriding-oxidizing temperature to generate a nitriding gas, and the inorganic powder has an average particle size of from 20 to 100 μm and does not react under the nitriding-oxidizing conditions; embedding an essential part of the metal member to be nitrided and oxidized into the powdery nitriding agent, wherein the metal member is composed of ferrous alloys or non-ferrous alloys, and then carrying out nitridization-oxidization at temperatures of 400 to 900° C. for 0.5 to 20 hours while an oxygen-containing gas is always present in the powdery nitriding agent; and allowing the metal member to carry out an oxidization in an oxygen-containing atmosphere (air or oxygen-rich air) at a temperature of 400 to 900° C. for 0.25 to 8 hours after the nitridization-oxidization. The nitriding-oxidizing conditions in early steps are the same as above-mentioned conditions. In reoxidization, for example, if an electric furnace is used, the electric furnace can be an open type, an oxygen controllable type, or a steam-introduced type electric furnace.

In the reoxidization, the formation of red ferric oxide ($Fe_2O_3$) rust layer on the top surface can be inhibited, and many dark black ferrosoferric oxide ($Fe_3O_4$) layers are formed by a temperature program as followed:

1. Heating profile is increased from room temperature to a predetermined temperature for reoxidization and then is held.
2. Heating profile is increased from room temperature to 360±20° C. and is held for a specific period of time, and then is increased to the predetermined temperature and held. The purpose of this temperature program is to allow moisture in the early steps to be evaporated, the formation of $Fe_2O_3$ to be inhibited, and $Fe_3O_4$ layer to be formed at high temperatures.
3. Heating profile is increased from room temperature to 360±20° C. and is held for a specific period of time, and then is increased to the predetermined temperature and steam is introduced. The introducing period of steam can vary with the requirement.

In reoxidization, nitrogen in the diffusion layer formed in the previous nitridization-oxidization can be dispersed again, so that a small hardness gradient formed.

Despite that oxide precipitate is produced in the diffusion layer by nitridization-oxidization under the condition that the oxygen-containing gas is present in the powdery nitriding agent, the amount of $Cr_2O_3$ precipitate in the diffusion layer will be increased due to a tight $Cr_2O_3$ layer formed on the surface. Consequently, the treated metal member has an excellent melting loss resistance to the melting loss (corrosion) resulting from electrochemical reactions between ferrous alloys and non-ferrous alloys (corrosion) and the melting loss resulting from abrasion of flowing liquid.

After nitridization-oxidization and reoxidization, the ferrous oxide layer, the mixing layer of chromium oxide with chromium nitrides are formed from the top surface inwards. The diffusion layer is a mixture of nitrogen diffusion layer with $Cr_2O_3$ precipitate.

The thickness and composition of the surface compound layers and the diffusion layer produced in nitridization-oxidization and the reoxidization, for example, is shown as followed:

Oxide layer: 2 to 20 μm in thickness, including $Fe_2O_3$, $Fe_3O_4$, $FeCr_2O_4$ and $Cr_2O_3$.

Nitride layer: 1 to 4 μm in thickness, including $Cr_2N$ and CrN.

Diffusion layer: 10 to 200 μm in thickness, including a nitrogen diffusion layer and $Cr_2O_3$ precipitate.

When reoxidization is carried out on tool steels and alloy steels (such as improved SKD61 material) underwent nitridization-oxidization, suitable treatment conditions are exemplified as below:

1. The problems resulting from low temperature operation or high temperature operation can be overcome by oxidized coatings produced in reoxidization. Low temperature operation includes lead free tin alloys soldering, and high temperature operation includes hot forging, hot battering, non-ferrous alloys casting, and the like. In this case, the temperature for reoxidization is preferably set at 500 to 600° C.
2. Tool steels and alloy steels are used after a "quenching-annealing" heat treatment, thus subsequent treatments at high temperatures become very important. Precision error or softening of hardness of dies and parts caused by inadequate temperature program must also be considered. In this case, reoxidizing temperature is preferably set at 520 to 560° C.

When the reoxidization is carried out on high-chromium steels, non-ferrous alloys undergone the nitridization-oxidization, suitable treatment conditions are exemplified as below:

The purpose of the reoxidization is to form an oxidized coating of $Fe_3O_4$ and $Cr_2O_3$ on the surface. Ferrous alloy steels with an oxidized coating can have a relatively better melting loss resistance comparing with aluminum alloys, lead (II) alloys, magnesium alloy, lead free tin alloy for soldering, and the like. Furthermore, high chromium steels are used for applications at room temperature, low temperatures and high temperatures.

1. In the case of applications at room temperature, wear resistance is considered. Dimension precision is also very important. The purpose of reoxidization is to form compound layers of $Fe_3O_4$ and $Cr_2O_3$. The temperature for reoxidization is preferably set at 480 to 520° C.
2. In the case of applications at low temperatures (150 to 400° C.), solder bath has a greater tolerance, and contacts with tin alloy liquid for a long time. Therefore, to terminate electrochemical reaction becomes very important, and the formation of a thicker, oxidized coating is required. The reoxidizing temperature is preferably set at 540 to 580° C.
3. In the case of applications at high temperatures, the reoxidizing temperature is preferably set at 520 to 580° C. to solve problems of seizing and melting loss (resulting from casting dies) of equipment parts for casting which contact with molten melt.

Ferrous alloys suitable for the nitridization-oxidization and reoxidization by using a powdery nitriding agent include high-speed tool steels, alloy tool steels, ultra-high strength steels, structural alloy steels containing chromium, molybdenum, manganese, tungsten, vanadium, or aluminum. Because the $Cr_2O_3$ oxidized layer formed on the top surface and $Cr_2O_3$ precipitate formed in the diffusion layer, ferrous alloys preferably contains 1% by weight of chromium.

Ferrous alloys that can be treated by the treatment of the present invention are exemplified in the following:

TABLE 1

| Types of Steel | Japan Industrial Standards |
|---|---|
| Cold work die steels | SKD-1, SKD-11, SKD-12 |
| Hot work die steels | SKD-4, SKD-5, SKD-7, SKD-8, SKD-61, SKD-62 |
| Plastic die steels | Cr-Mo, 13Cr-stainless steel, Ni—Cr—Mo, Ni—Cr—Mo—Cu, precipitation hardening |
| High-speed tool steels | SKH-3, SKH-4, SKH-51 |
| Powdery high-speed tool steels | (HAP, ASP, DEX) |
| Chromium-molybdenum steels | SCM-432, SCM-435, SCM-440, SCM-445, SCM-822 |
| Ultra-high strength steels | (YAG, MAS-1, MAALOK) |
| Austenitic stainless steels | SUS-303, SUS-304, SUS-316 |
| Ferritic stainless steels | SUS-405, SUS-430, SUS-430F |
| Martensitic stainless steels | SUS-410, SUS-420J2, SUS-420F, SUS-403, SUS-440C, SUS-416 |
| Martensitic heat-resistant steels | SUH-1, SUH-3, SUH-4, SUH-11 |
| Austenitic heat-resistant steels | SUH-31, SUH-36, SUH-37 |
| Cast stainless steels | SCS1 to 2, SCS11 to 18, SCH1 to 2, SCH1 to 15 |
| High-manganese cast steels | SCMn-H1 to H2 |
| Cast corrosion-resistant steels | Niresist-A, Niresist-B |

TABLE 1-continued

| Types of Steel | Japan Industrial Standards |
|---|---|
| Structural alloy cast steels | SCMn-1 to 3, SCMnCr-2 to 4, SCSiMn-2, SCMnM-3, SCCrM-1, SCCrM-3 |

Even in the case of metal members with inert oxidized coatings, the nitriding-oxidizing method also can be applied without pretreatment for removing the oxidized coating, by degrading ammonia into hydrogen ions at high temperatures and reducing such hydrogen ions with oxygen in the inert oxidized coatings.

First Embodiment

A metal member consisting of SKD61 was embedded in a powdery nitriding agent consisting of 20% by volume of dicyandiamide with an average particle size of 6 μm and 80% by volume of $Al_2O_3$ with an average particle size of 70 μm. Nitridization-oxidization was carried out on the metal member in an open type electric furnace at a temperature of 460, 480, 500, 520, 540, 560 or 580° C. for 15 hours while an oxygen-containing gas was always present in the powdery nitriding agent. The hardness of the metal member treated at each of the above-mentioned temperatures was measured. The results are shown in FIG. 1. In FIG. 1, the latitudinal vector is the distance (μm) from the surface and the longitudinal vector is Vickers pyramid number (Hv).

Second Embodiment

Figure 2:
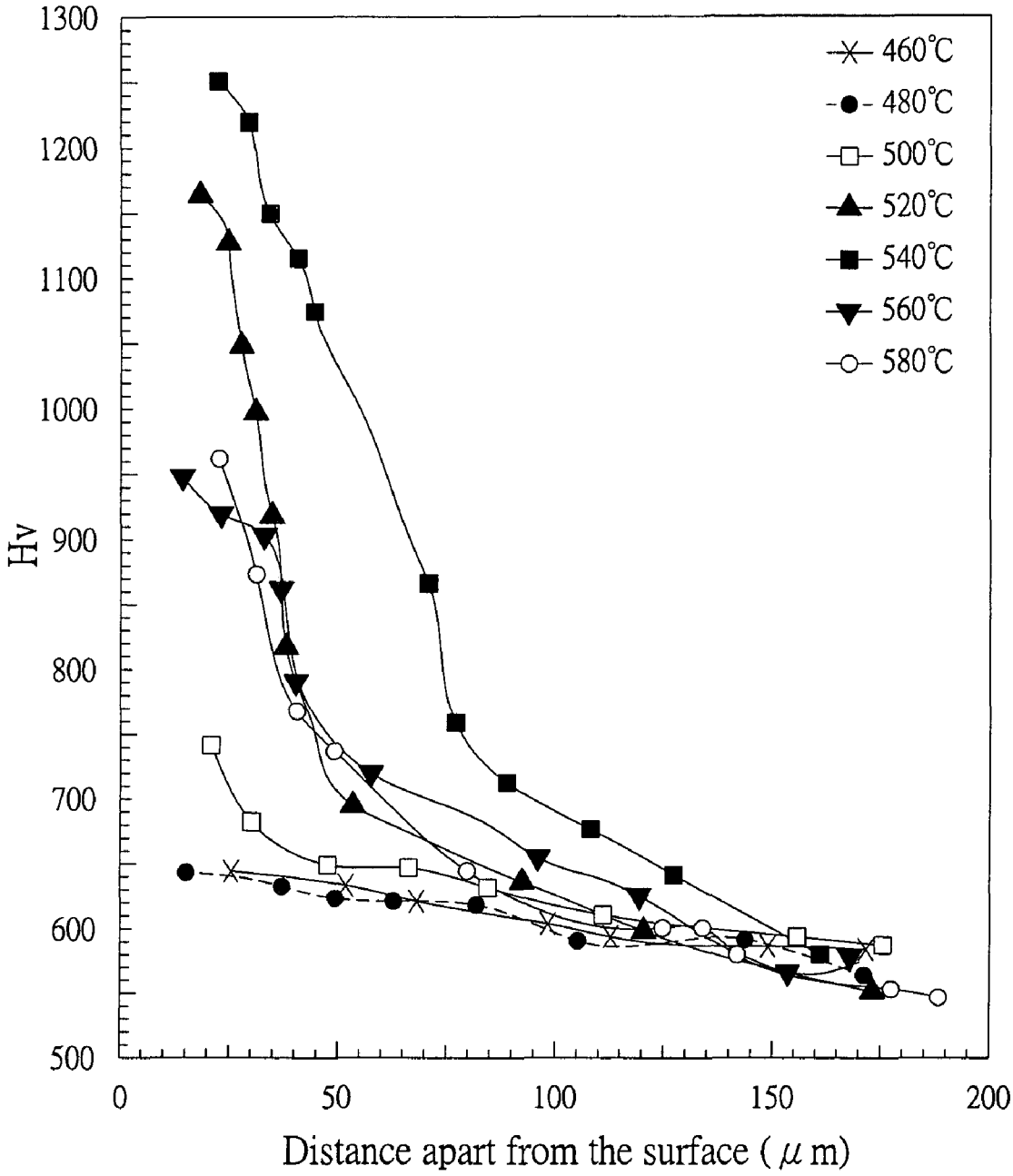
FIG. 2 is a graph of the measured hardness distribution according to the second embodiment of the present invention.

A metal member consisting of SKD61 was embedded in a powdery nitriding agent consisting of 40% by volume of dicyandiamide with an average particle size of 6 μm and 60% by volume of $Al_2O_3$ with an average particle size of 70 μm. Nitridization-oxidization was carried out on the metal member in an open type electric furnace at a temperature of 460, 480, 500, 520, 540, 560 or 580° C. for 15 hours while an oxygen-containing gas was always present in the powdery nitriding agent. The hardness of the metal member treated at each of the above-mentioned temperature was measured. The results are shown in FIG. 2. In FIG. 2, the latitudinal vector is the distance (μm) from the surface and the longitudinal vector is Vickers pyramid number (Hv).

Third Embodiment

Figure 3:
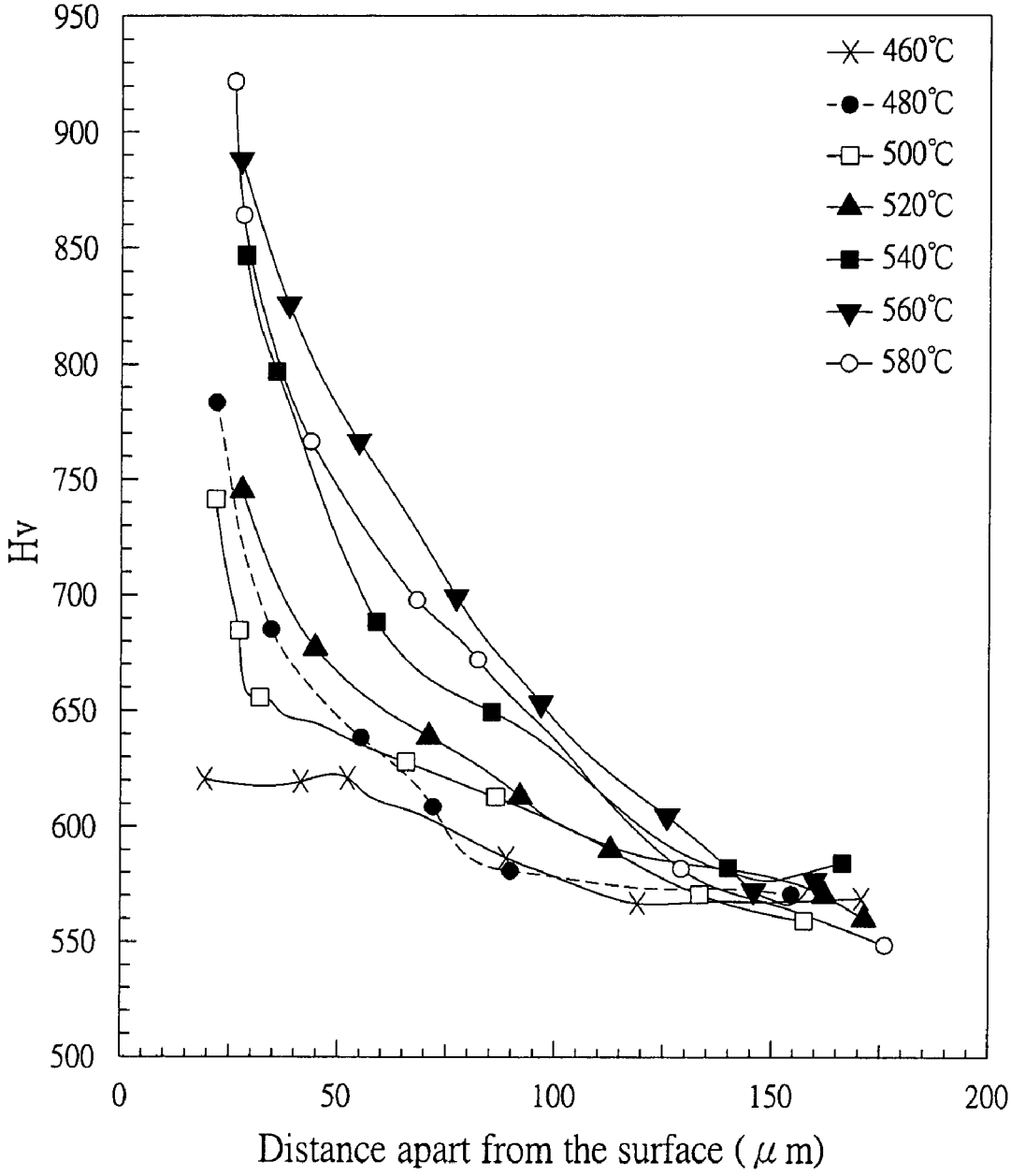
FIG. 3 is a graph of the measured hardness distribution according to the third embodiment of the present invention.

A metal member consisting of SKD61 was embedded in a powdery nitriding agent consisting of 70% by volume of dicyandiamide with an average particle size of 6 μm and 30% by volume of $Al_2O_3$ with an average particle size of 70 μm. Nitridization-oxidizing was carried out on the metal member in an open type electric furnace at a temperature of 460, 480, 500, 520, 540, 560 or 580° C. for 15 hours while an oxygen-containing gas was always present in the powdery nitriding agent. The hardness of the metal member treated at each of the above-mentioned temperature was measured. The results are shown in FIG. 3. In FIG. 3, the latitudinal vector is the distance (μm) from the surface and the longitudinal vector is Vickers pyramid number (Hv).

Fourth Embodiment

Figure 4:
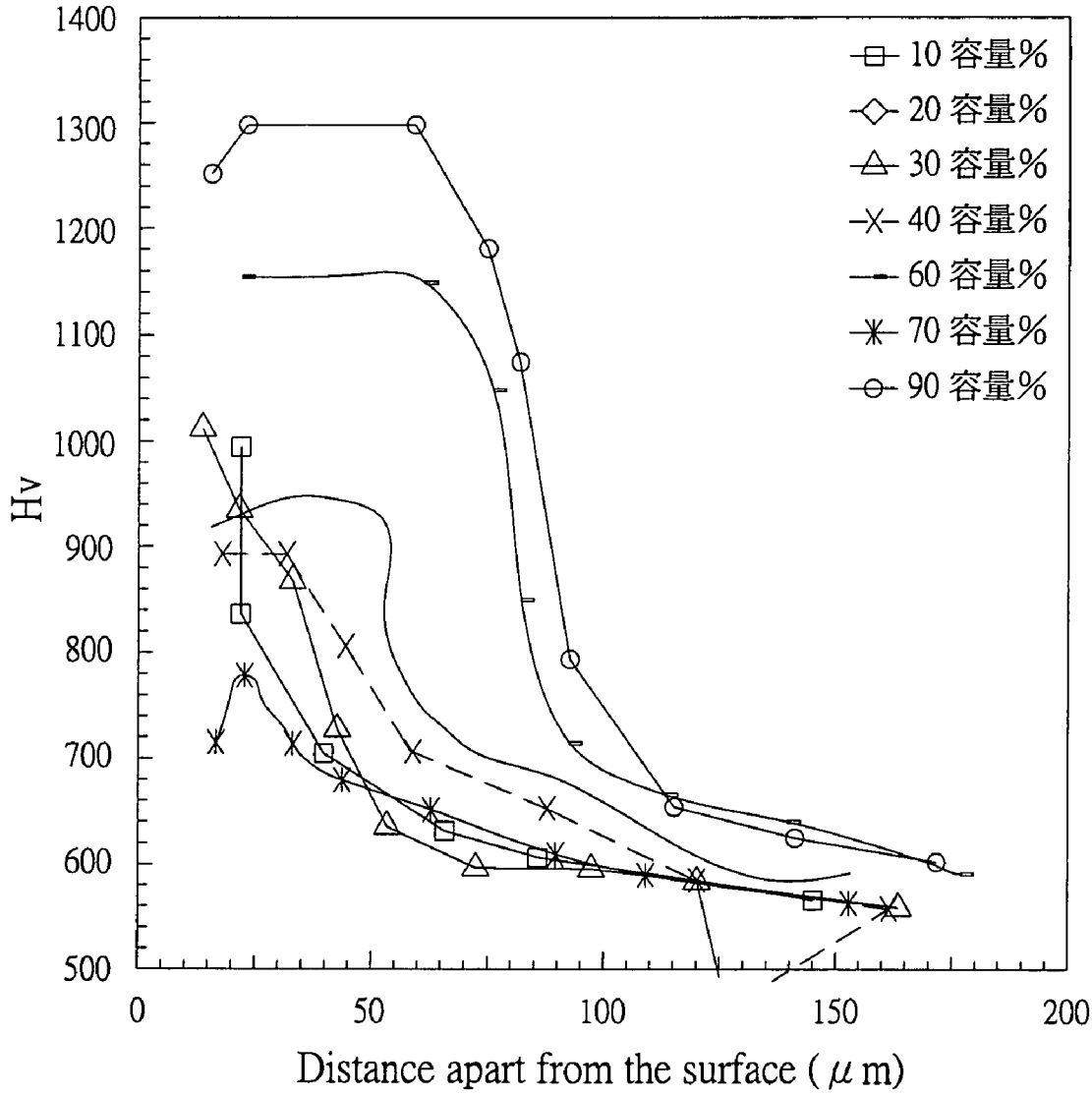
FIG. 4 is a graph of the measured hardness distribution according to the fourth embodiment of the present invention.

A metal member consisting of SKD61 was embedded in a powdery nitriding agent consisting of 10, 20, 30, 40, 60, 70 or 90% by volume of dicyandiamide with an average particle size of 6 μm and a corresponding residual amount of $Al_2O_3$ with an average particle size of 70 μm. Nitridization-oxidization was carried out on the metal member in an open type electric furnace at 520° C. for 15 hours while an oxygen-containing gas was always present in the powdery nitriding agent. Thereafter, the metal member underwent reoxidization under atmosphere at 520° C. for 6 hours. The hardness of the metal member treated as above-mentioned was measured. The results are shown in FIG. 4. In FIG. 4, the latitudinal vector is the distance (μm) from the surface and the longitudinal vector is Vickers pyramid number (Hv).

Fifth Embodiment

Figure 5:
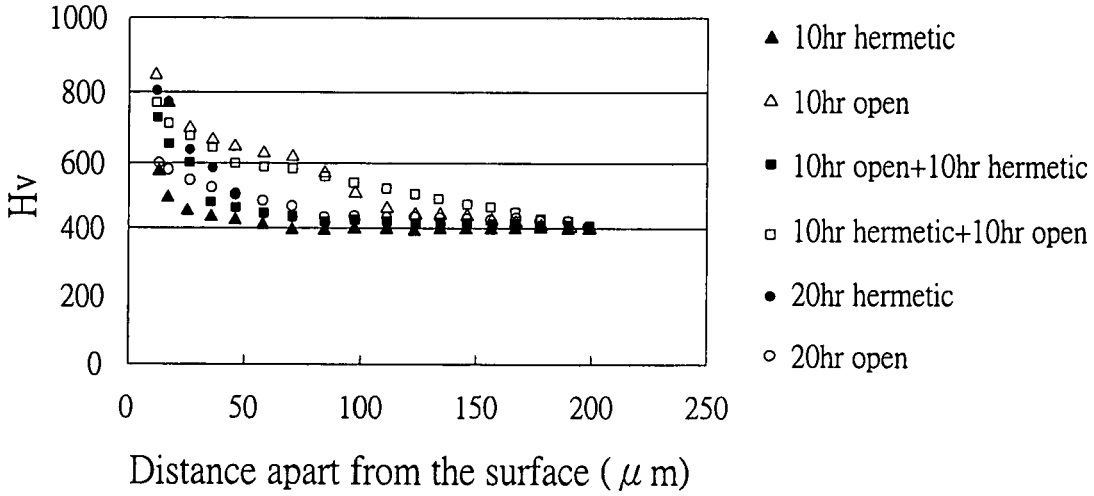
FIG. 5 is a graph of the measured hardness distribution according to the fifth embodiment of the present invention.

A metal member consisting of SKD61 was embedded in a powdery nitriding agent consisting of 20% by volume of dicyandiamide with an average particle size of 6 μm and 80% by volume of $Al_2O_3$ with an average particle size of 70 μm. Nitridization-oxidization was carried out on the metal member in an open type or hermetic type electric furnace at 540° C. for 10 or 20 hours while an oxygen-containing gas was always present in the powdery nitriding agent. The hardness of the metal member treated as above-mentioned was measured. The results are shown in FIG. 5.

Additionally, a metal member consisting of SKD61 was embedded in a powdery nitriding agent consisting of 20% by volume of dicyandiamide with an average particle size of 6 μm and 80% by volume of $Al_2O_3$ with an average particle size of 70μm. Nitridization-oxidization was carried out on the metal member in an open type or hermetic type electric furnace at 540° C. for 10 hours while an oxygen-containing gas was always present in the powdery nitriding agent. Thereafter, the metal members underwent reoxidization in an open type or hermetic type electric furnace at 540° C. for 10 hours. The hardness of the metal member treated as above-mentioned was measured. The results are shown in FIG. 5. In FIG. 5, the latitudinal vector is the distance (μm) from the surface and the longitudinal vector is Vickers pyramid number (Hv).

The invention has been described using exemplary preferred embodiments. However, it is to be understood that the scope of the invention is not limited to the disclosed embodiments. On the contrary, it is intended to cover various modifications and similar arrangements. The scope of the claims therefore should be accorded the broadest interpretation so as to encompass all such modifications and similar arrangements.

What is claimed is:

1. A nitriding-oxidizing method for a metal member, comprising the steps of:

providing a powdery nitriding agent comprised of 10 to 90% by volume of a powdery nitride compound and 90 to 10% by volume of an inorganic powder, wherein the powdery nitride compound has an average particle size of from 1 to 10 μm and decomposes below a temperature of a nitriding-oxidizing treatment to generate a nitriding gas, and the inorganic powder has an average particle size of from 20 to 100 μm but does not react under the nitriding-oxidizing treatment; and embedding an essential part of the metal member to be nitrided and oxidized into the powdery nitriding agent, wherein the metal member is composed of ferrous alloys or non-ferrous alloys; and then performing the nitriding-oxidizing method at a temperature of 400 to 900° C. for 0.5 to 20 hours while an oxygen-containing gas is always present in the powdery nitriding agent, wherein the inorganic powder comprises at least one of metal oxides, complex metal oxides, ceramics and minerals.

2. The nitriding-oxidizing method of claim 1, wherein the metal member is composed of ferrous alloys or non-ferrous alloys containing chromium, molybdenum, manganese, tungsten, vanadium or aluminum.

3. A nitriding-oxidizing and reoxidizing method for a metal member, comprising the steps of:

providing a powdery nitriding agent comprised of 10 to 90% by volume of a powdery nitride compound and 90 to 10% by volume of an inorganic powder, wherein the powdery nitride compound has an average particle size of from 1 to 10 μm and decomposes below a temperature of a nitriding-oxidizing treatment to generate a nitriding gas, and the inorganic powder has an average particle size of from 20 to 100 μm and does not react in the nitriding-oxidizing treatment;

embedding an essential part of the metal member to be nitrided and oxidized into the powdery nitriding agent, wherein the metal member is composed of ferrous alloys or non-ferrous alloys, and then carrying out the nitriding-oxidizing method at a temperature of 400 to 900° C. for 0.5 to 20 hours while an oxygen-containing gas is always present in the powdery nitriding agent; and allowing the metal member after the nitriding-oxidizing treatment to carry out a reoxidization in an oxygen-containing atmosphere at a temperature of 400 to 900° C. for 0.25 to 8 hours, wherein the inorganic powder comprises at least one of metal oxides, complex metal oxides, ceramics and minerals.

4. The nitriding-oxidizing and reoxidizing method of claim 3, wherein the metal member is composed of ferrous alloys or non-ferrous alloys containing chromium, molybdenum, manganese, tungsten, vanadium or aluminum.

* * * * *